US011318491B2

(12) United States Patent
Chen et al.

(10) Patent No.: US 11,318,491 B2
(45) Date of Patent: May 3, 2022

(54) SOLAR LANDSCAPE APPARATUS

(71) Applicant: Giant Electric Tech Inc, Shenzhen (CN)

(72) Inventors: Hui Chen, Shenzhen (CN); Dui He, Shenzhen (CN)

( * ) Notice: Subject to any disclaimer, the term of this patent is extended or adjusted under 35 U.S.C. 154(b) by 0 days.

(21) Appl. No.: 17/084,662

(22) Filed: Oct. 30, 2020

(65) Prior Publication Data

US 2022/0008950 A1 Jan. 13, 2022

(30) Foreign Application Priority Data

Jul. 13, 2020 (CN) ..... 202021387328.0

(51) Int. Cl.

| | |
|---|---|
| ***B05B 17/08*** | (2006.01) |
| ***F21S 9/03*** | (2006.01) |
| ***F21V 33/00*** | (2006.01) |
| ***F21V 21/00*** | (2006.01) |
| ***F21W 131/109*** | (2006.01) |
| ***F21Y 115/10*** | (2016.01) |
| ***F21W 121/02*** | (2006.01) |

(52) U.S. Cl.

CPC ..... *B05B 17/08* (2013.01); *F21S 9/037* (2013.01); *F21V 21/00* (2013.01); *F21V 33/006* (2013.01); *F21W 2121/02* (2013.01); *F21W 2131/109* (2013.01); *F21Y 2115/10* (2016.08)

(58) Field of Classification Search

CPC ..... F21S 9/037; B05B 17/08; F21W 2121/02

See application file for complete search history.

(56) References Cited

U.S. PATENT DOCUMENTS

| | | | | |
|---|---|---|---|---|
| 4,920,465 | A * | 4/1990 | Sargent | F21S 9/046 239/18 |
| 6,179,218 | B1 * | 1/2001 | Gates | B05B 17/08 239/17 |
| 6,375,090 | B1 * | 4/2002 | Beidokhti | B05B 17/08 239/16 |
| 6,435,422 | B1 * | 8/2002 | Wutschik | B05B 17/08 239/18 |
| 2002/0179728 | A1 * | 12/2002 | Beidokhti | B05B 17/08 239/20 |
| 2017/0159927 | A1 * | 6/2017 | Hui | F21V 31/00 |
| 2019/0091716 | A1 * | 3/2019 | Fuller | B63B 35/00 |
| 2019/0323669 | A1 * | 10/2019 | Tang | F21V 23/045 |

FOREIGN PATENT DOCUMENTS

| | | | |
|---|---|---|---|
| CN | 204353055 U | * | 5/2015 |
| JP | 08196966 A | * | 8/1996 |

* cited by examiner

*Primary Examiner* — Alexander K Garlen

(57) ABSTRACT

A solar landscape apparatus having a floating body, a support member, a solar panel, a battery and an electrical device is disclosed. The floating body is composed of a material with a density lower than that of water. The solar panel, the battery and the electrical device are respectively located on the floating body and the battery is electrically connected with the solar panel and the battery respectively. The support member is installed on the floating body and at least a part of the support member protrudes from a periphery of the floating body to prevent the floating body from leaning against a water edge. Through the part of the support member protruding from the periphery of the floating body, the floating body is kept at a preset distance from the water edge, thus effectively improving the landscape effect.

14 Claims, 5 Drawing Sheets

SOLAR LANDSCAPE APPARATUS

TECHNICAL FIELD

The present disclosure relates generally to a landscape decoration technical field, and more particularly relates to a solar landscape apparatus.

BACKGROUND

The fountain in the garden or square is a decorative water spraying device which is constructed artificially for landscape and can moisten the surrounding air, reduce the dust and decrease the temperature. The tiny water droplets of the fountain collide with the air molecules, which can produce a large number of negative oxygen ions. Meanwhile, the landscape lights can create special visual effects.

The existing landscape apparatus, such as the fountains and landscape lights, are widely used in the lakes, the waterscape of various real estate communities and large pools of the villas. Most of these landscape apparatus are fixed at the bottom of the pool and powered by the fixed cables, which not only waste the electrical power, but also are troublesome in wiring and installation.

Solar energy floating fountain and solar water floating light powered by the solar cells, are widely used in the landscape lighting filed for their advantages of energy saving and environmental protection.

However, as the above solar energy floating fountain and solar water floating light are floating on the water surface, they are likely to drift to the water edge under the action of wind or water current, thus affecting the landscape effect. For example, when the solar floating fountains in the bird bath tray, the small spray scene and the small pool float to the water edge, the upward water jet is easy to spray out.

SUMMARY

The present disclosure has provided a solar landscape apparatus, aiming at the technical problem that the existing solar energy floating fountain and solar water floating light are likely to drift to the water edge under the action of wind or water current, thus affecting the landscape effect.

According to an aspect, a solar landscape apparatus is provided, which comprising a floating body, a support member, a solar panel, a battery and an electrical device; wherein the floating body is composed of a material with a density lower than that of water; wherein the solar panel, the battery and the electrical device are respectively located on the floating body and the battery is electrically connected with the solar panel and the battery respectively; wherein the support member is installed on the floating body and at least a part of the support member protrudes from a periphery of the floating body to prevent the floating body from leaning against a water edge.

Advantageously, the support member comprises a plurality of support rods, wherein a first end of each support rod is fixed on the floating body through a detachable assembly member, and a second end of each support rod protrudes from the periphery of the floating body.

Advantageously, the support rod has a density which is higher than or equal to that of the water, and when the solar landscape apparatus is floating on a water surface, the support rod is located below the water surface.

Advantageously, the plurality of support rods are radially distributed around the floating body, and a length of the second end of the support rod protruding from the periphery of the floating body is not less than a half of a width of the floating body.

Advantageously, the detachable assembly member comprises a horizontal connection portion and a first insertion portion integrated with the horizontal connection portion and arranged at a backside of the horizontal connection portion; wherein the detachable assembly member is fixed to an edge of the floating body through the horizontal connection portion and the first end of the support rod is inserted into the first insertion portion.

Advantageously, the first insertion portion is formed by an insertion hole and the first end of the support rod is inserted into the insertion hole.

Advantageously, the first insertion portion is formed by a convex pillar and the first end of the support rod is provided with a perforation for inserting the convex pillar.

Advantageously, the detachable assembly member comprises a clamping groove portion and a second insertion portion integrated with the clamping groove portion and located on one side of the clamping groove portion; wherein the detachable assembly member is fixed to an edge of the floating body through the clamping groove portion and the first end of the support rod is inserted into the second insertion portion.

Advantageously, the clamping groove portion includes a vertical clamping groove and an edge of a support plate of the floating body is provided with a vertical fastener, wherein a detachable assembly member is fixed to the support plate by inserting the vertical fastener into the vertical clamping groove of the clamping groove portion.

Advantageously, the detachable assembly member comprises a conical insertion joint and a third insertion portion integrated with the conical insertion joint and arranged at a backside of the conical insertion joint; wherein the detachable assembly member is fixed to an edge of the floating body through the conical insertion joint and the first end of the support rod is inserted into the third insertion portion.

Advantageously, the floating body comprises a floating plate and a floater, and the conical insertion joint is directly inserted and fixed to the floater.

Advantageously, a periphery of the conical insertion joint is provided with a barbed structure.

Advantageously, the support member comprises an annular blocking ring and the second ends of the plurality of the support rods are detachably connected with the annular blocking ring, respectively.

Advantageously, the electrical device comprises a first circuit board and a water pump; wherein the floating body is provided with a through-hole and the solar panel is located on an upper surface of the floating body; wherein the first circuit board, the water pump and the battery are respectively installed on a lower surface of the floating body; wherein the water pump and the battery are respectively electrically connected with the first circuit board.

Advantageously, the electrical device comprises a second circuit board and a LED lamp bead located on an upper surface of the second circuit board; wherein the solar panel is fixed on an upper surface of the floating body, the battery is installed on a lower surface of the floating body, wherein the second circuit board is fixed on the upper surface of the floating body and is electrically connected with the battery.

The solar landscape apparatus disclosed in the present disclosure has following beneficial effect. Through the part of the support member protruding from the periphery of the floating body, the floating body is kept at a preset distance from the water edge, thus effectively improving the landscape effect.

DETAILED DESCRIPTION OF THE PREFERRED EMBODIMENT

To make the object, the technical solution, and the advantage of the present disclosure more clearly, the present disclosure is further described in detail below with reference to the accompanying embodiments. It should be understood that the specific embodiments described herein are just a part of rather than all the embodiments of the present disclosure. All other embodiments obtained by one skilled in the art without inventive works based on the embodiment of the present disclosure, fall into the protection scope of the present disclosure.

Figure 1:
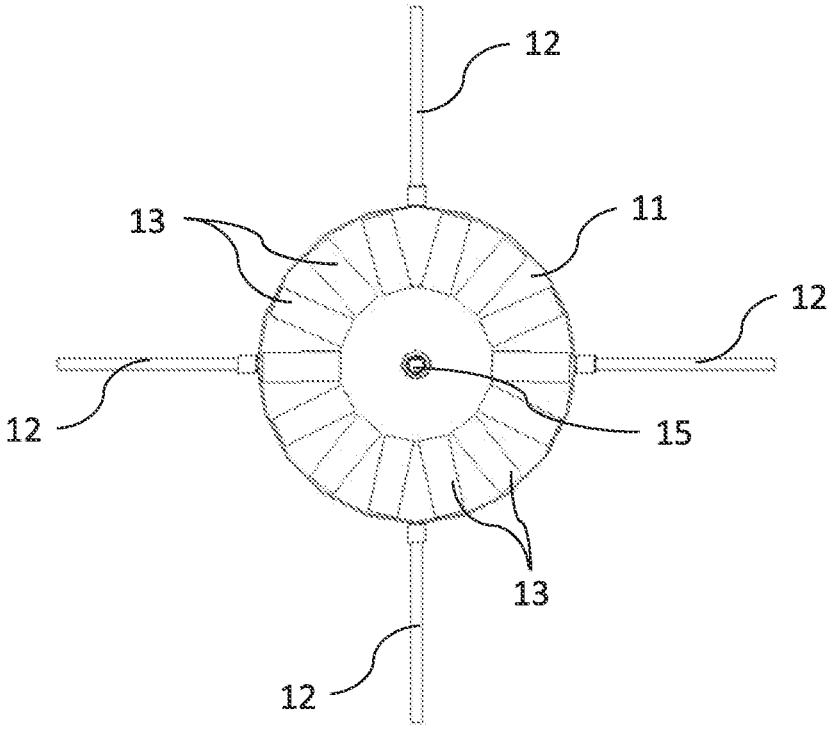
FIG. 1 is a schematic diagram of the solar landscape apparatus according to an embodiment of the present disclosure.

FIG. 1 is a schematic diagram of the solar landscape apparatus according to an embodiment of the present disclosure. The solar landscape apparatus as shown in FIG. 1 can be applied to the garden landscape, water pool, bird bath tray, etc. to improve the visual effect. The solar landscape apparatus according to the present embodiment includes a floating body 11, a support member 12, a solar panel 13, a battery and an electrical device 15. The solar panel 13, the battery and the electrical device 15 are respectively located on the floating body 11. The battery is electrically connected with the solar panel 13 and the electrical device 15 respectively. The battery can store the electric energy generated by the solar panel 13 through receiving the sunlight and supply the electrical power to the electrical device 15. The support member 12 is installed on the floating body 11, and at least a part of the support member 12 protrudes from the periphery of the floating body 11 to prevent the floating body 11 from leaning against the water edge. The floating body 11 is composed of a material with a density lower than that of the water, and the overall density of the solar landscape apparatus composed of the floating body 11, the support member 12, the solar panel 13, the battery and the electrical device 15 is also lower than that of the water.

Since the overall density of the solar landscape apparatus is lower than that of the water, when the solar landscape apparatus is placed into the water, it floats on the water surface. Moreover, since at least a part of the support member 12 protrudes out of the periphery of the floating body 11, when the floating body 11 is close to the water edge, the part of the support member 12 protruding from the periphery of the floating body 11 leans against the water edge (such as the inner sides of the pool and bird bath tray) firstly, so as to keep a certain distance between the floating body 11 and the water edge, thus avoiding affecting the landscape effect.

Figure 2:
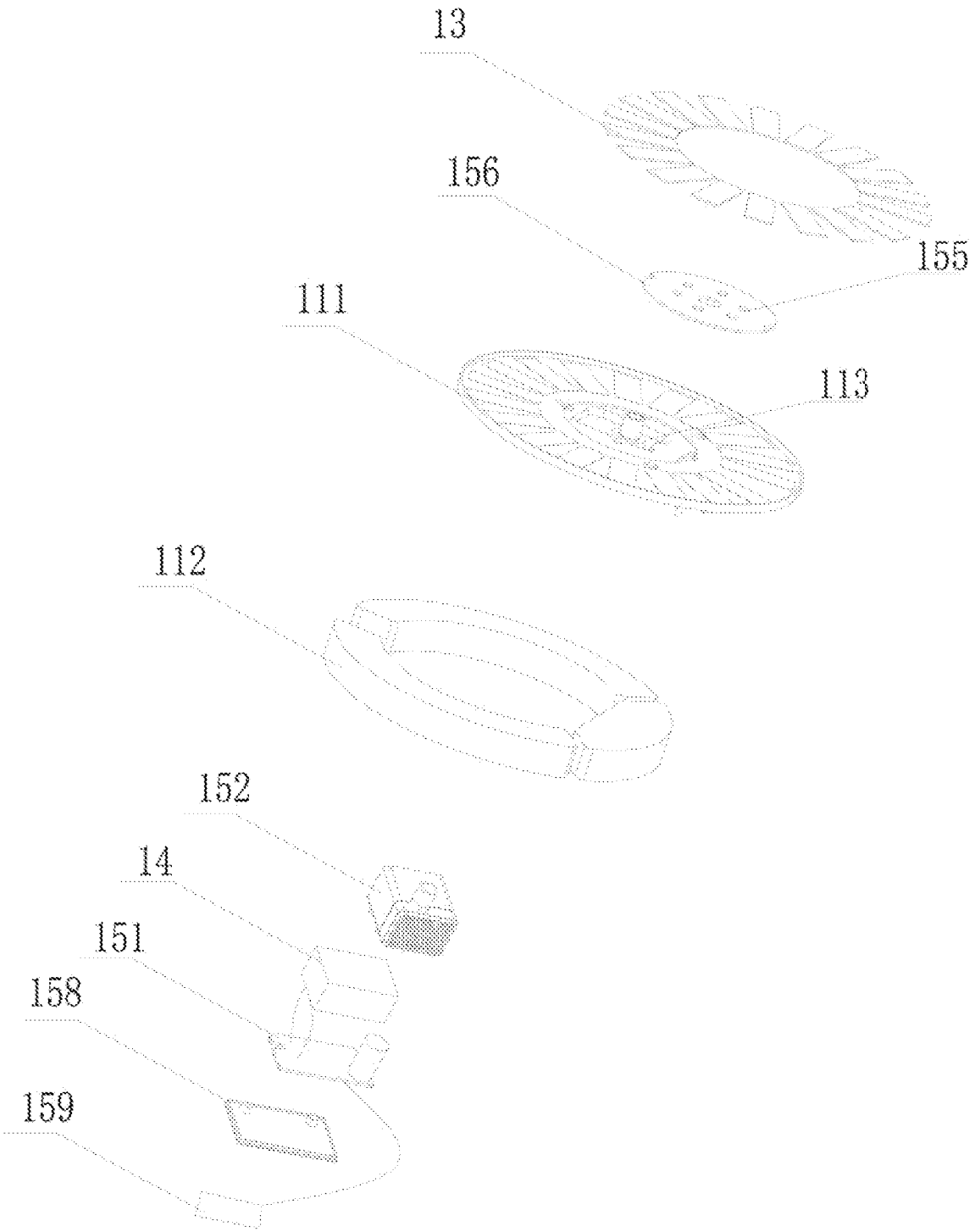
FIG. 2 is a decomposition diagram of the floating body, solar panel, battery and electrical device in the solar landscape apparatus according to an embodiment of the present disclosure.

The electrical device 15 can be a fountain device. As shown in FIG. 2, the electrical device 15 includes a first circuit board 151 and a water pump 152. Accordingly, the floating body 11 is provided with a through-hole 113. Specifically, the floating body 11 is composed of a support plate 111 and a floater 112 which is made of a material with a low density, such as the porous plastic or foam. The support plate 111 is located on the upper surface of the floater 112. The solar panel 13 is located on the upper surface of the support plate 111 (i.e., the upper surface of the floating body 11). The first circuit board 151, the water pump 152 and the battery 14 are respectively installed on the lower surface of the floater 112 (i.e., the lower surface of the floating body 11). The water pump 152 and the battery 14 are respectively electrically connected with the first circuit board 151. The battery 14 has a waterproof case. The water outlet of the water pump 152 is provided with a water spray head passing through the through-hole and being located above the floating body 11. Thus, the first circuit board 151 can drive the water pump 152 to run on the power supply of the battery 14, and then realize the water spraying through the water spray head of the water pump 152.

To be specific, the lower surface of the support plate 111 is provided with an installation cavity, in which the first circuit board 151 and the battery 14 are respectively installed. The floater 112 is provided with a relief hole and when the floater 112 is fixed to the lower surface of the support plate 111, the installation cavity and the water pump 152 respectively pass through the relief hole on the floater 112.

In addition, the electrical device 15 also includes a water level sensor 159 fixed on the first circuit board 151, and the bottom of the installation cavity is provided with an installation cavity cover 158. The battery 14 and the first circuit board 151 are located in the installation cavity which is filled with the epoxy resin to ensure the sealing and waterproof of the battery 14 and the first circuit board 151.

The electrical device 15 can be a landscape lamp, which comprises a second circuit board 156 and a plurality of LED lamp beads 155 respectively located on the upper surface of the second circuit board 156. The second circuit board 156 is fixed on the upper surface of the floating body 11, and the second circuit board 156 is electrically connected with the battery 14 through the electrical wire, so that the LED lamp beads 155 are powered by the electric energy provided by the battery 14.

In an embodiment of the present disclosure, the second circuit board 156 can be a circular or regular polygon centered on the through hole 113 on the floating body 11, and the plurality of LED lamp beads 155 are uniformly distributed around the through-hole 113. The solar panel 13 is quadrilateral, and the plurality of solar panels 13 are uniformly distributed and close to the periphery of the second circuit board 156. Of course, in the practical application, the solar panel 13 and the second circuit board 156 can also adopt other shapes and distribution modes.

In practical application, the electrical device 15 can include both of the fountain device and landscape lamp, as well as either fountain device or landscape lamp. Of course, the above electrical device also includes other devices, such as music players.

Figure 3:
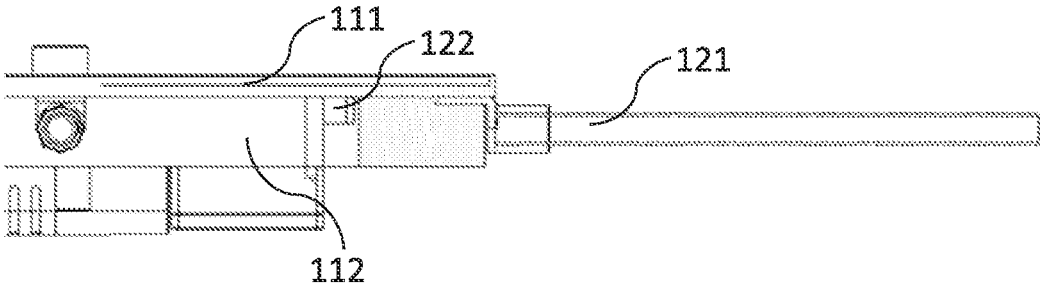
FIG. 3 is a schematic diagram of the assembly structure between the support rod and the floating body in the solar landscape apparatus according to an embodiment of the present disclosure.

In an embodiment of the present disclosure, the support member 12 comprises a plurality of support rods 121 which may be the solid or hollow rods. As shown in FIG. 3, the first end of each support rod 121 is fixed on the floating body 11 through the detachable assembly member 122, and the second end of each support rod 121 protrudes from the periphery of the floating body 11. Thus, when the floating body 11 is close to the water edge, the second end of the support rod 121 can lean against the inner side of the water container to prevent the floating body 11 from being too close to the water edge.

Moreover, the support member 12 adopts a plurality of support rods 121 which are detachably assembled to the floating body 11. These support rods 121 can be removed from the floating body 11 during the transportation and then mounted onto the floating body 11 before the solar landscape device is put into the water, thus greatly facilitating the transportation of the solar landscape device.

In another embodiment, the density of the support rod 121 is higher than or equal to the water density, and when the solar landscape device floats on the water surface, the support rod 121 is located below the water surface. Through this manner, the overall landscape effect will not be affected by the existence of the support rod 121. In particular, after the plurality of support rods 121 are installed on the floating body 11, the plurality of support rods 121 may be located in the same plane which is located below the plane of the floating body 11.

Preferably, the plurality of support rods 121 of the support member 12 are radially distributed around the floating body 11, and the length of the second end of the support rod 121 protruding from the periphery of the floating body is not less than a half of the width of the floating body 11. Preferably, the plurality of support rods 121 fixed to the same floating body 11 can have the same or different lengths. For example, when the floating body 11 is disc-shaped, the length of the second end of the support rod 121 protruding from the periphery of the floating body 11 is not less than the radius of the floating body 11. Of course, in the actual use process, the support rod 121 can also be cut according to the specific application field. For example, when it is applied to the bird bath tray, part of the support rod 121 can be cut.

Figure 4:
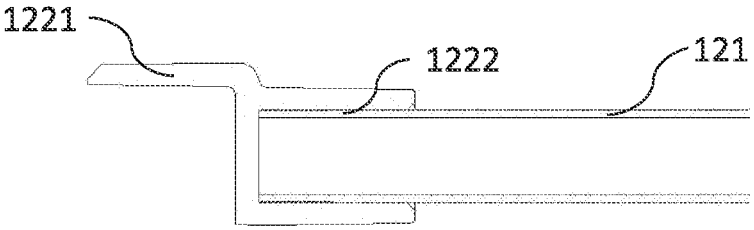
FIG. 4 is a structural schematic diagram of the support rod and one assembly member shown in FIG. 3.
Figure 5:
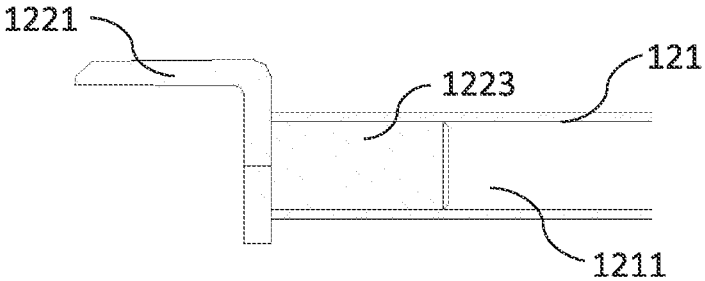
FIG. 5 is a structural schematic diagram of the support rod and another assembly member shown in FIG. 3.

As shown in FIGS. 4 and 5, the detachable assembly member 122 may specifically include a horizontal connection portion 1221 and a first insertion portion integrated with the horizontal connection portion 1221 and arranged at the backside of the horizontal connection portion 1221. The detachable assembly member 122 is fixed to the edge of the floating body 11 through the horizontal connection portion and the first end of the support rod 121 is inserted into the first insertion portion. For example, the detachable assembly member 122 can be inserted between the support plate 111 of the floating body 11 and the floater 112. In particular, for guaranteeing the connection strength, the detachable assembly member 122 can be fixed by gluing or screw locking.

Particularly, the first insertion portion can specifically adopt the insertion hole 1222 or the convex pillar 1223. When the first insertion portion is the convex pillar 1223, the support rod 121 should be a hollow structure or the first end of the support rod 121 is provided with a perforation 1211. The shape and size of the periphery of the convex pillar 1223 can match the shape and size of the perforation 1211 of the support rod 121.

Figure 6:
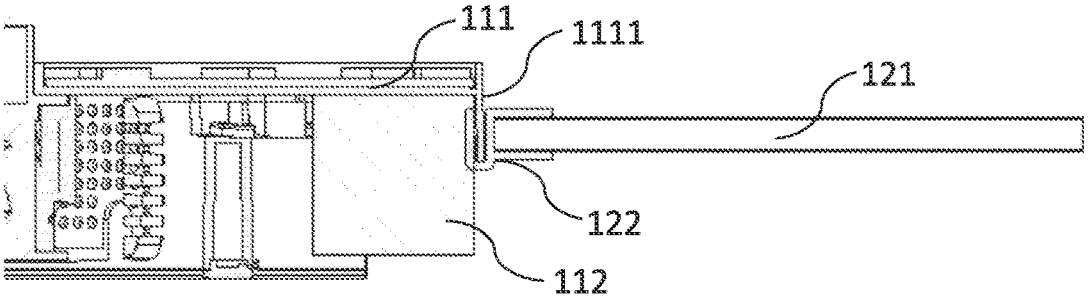
FIG. 6 is a schematic diagram of the assembly structure between the support rod and the floating body in the solar landscape apparatus according to another embodiment of the present disclosure.
Figure 7:
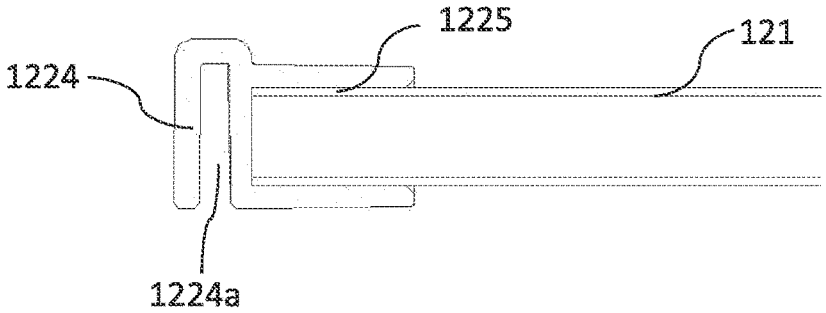
FIG. 7 is a structural schematic diagram of the support rod and one assembly member shown in FIG. 6.
Figure 8:
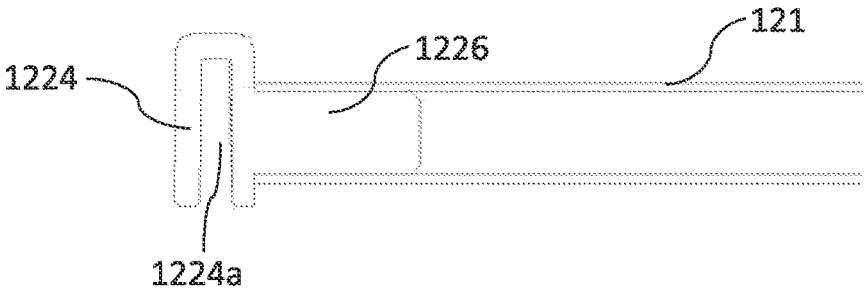
FIG. 8 is a structural schematic diagram of the support rod and another assembly member shown in FIG. 6.

As shown in FIGS. 6-8, in another embodiment of the present disclosure, the detachable assembly member 122 comprises a clamping groove portion 1224 and a second insertion portion integrated with the clamping groove portion 1224 and located on one side of the clamping groove portion 1224. The detachable assembly member 122 is fixed to the edge of the floating body 11 through the clamping groove portion 1224, and the first end of the support rod 121 is inserted into the second insertion portion. Specifically, the clamping groove portion 1224 includes a vertical clamping groove **1224*a*, and the edge of the support plate 111 of the floating body 11 is provided with a vertical fastener 1111. The detachable assembly member 122 is fixed to the support plate 111 by inserting the vertical fastener 1111 into the clamping groove 1224*a* of the clamping groove portion 1224**.

In particular, the second insertion portion can specifically adopt the insertion hole 1225 or the convex pillar 1226. When the second insertion portion is the convex pillar 1226, the support rod 121 should be a hollow structure or the first end of the support rod 121 is provided with an insertion hole. The shape and size of the periphery of the convex pillar 1226 can match the shape and size of the perforation of the support rod 121.

Figure 9:
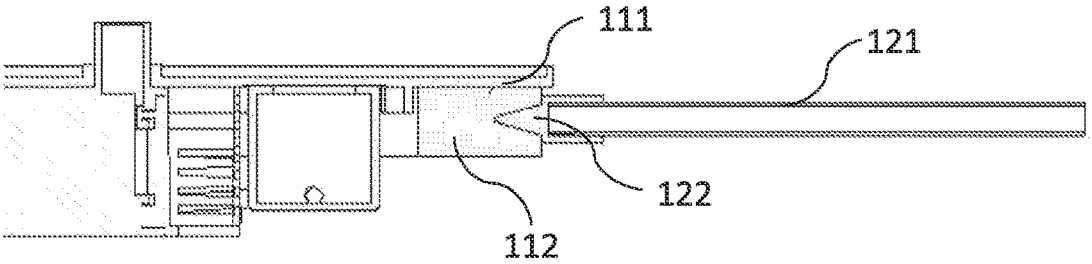
FIG. 9 is a schematic diagram of the assembly structure between the support rod and the floating body in the solar landscape apparatus according to a further embodiment of the present disclosure.
Figure 10:
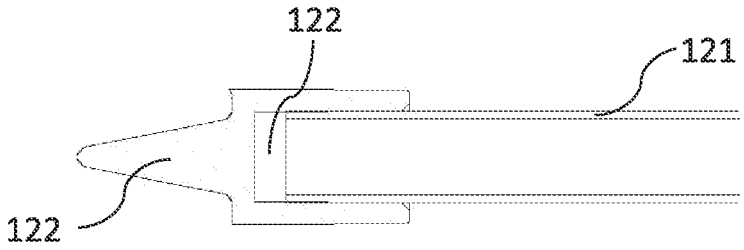
FIG. 10 is a structural schematic diagram of the support rod and one assembly member shown in FIG. 9.
Figure 11:
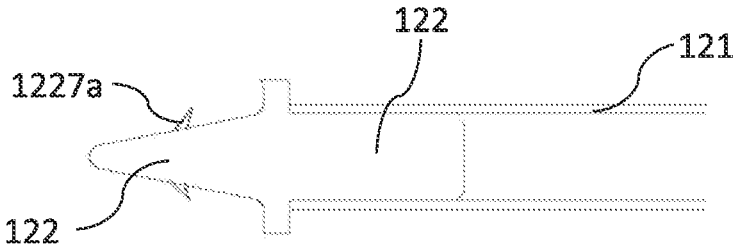
FIG. 11 is a structural schematic diagram of the support rod and another assembly member shown in FIG. 9.

As shown in FIGS. 9-11, in another embodiment of the present disclosure, the detachable assembly member 122 includes a conical insertion joint 1227 and a third insertion portion integrated with the conical insertion joint 1227 and arranged at the backside of the conical insertion joint 1227. The detachable assembly member 122 is fixed to the edge of the floating body 11 through the conical insertion joint 1227, and the first end of the support rod 121 is inserted into the third insertion portion. To be specific, the conical insertion joint 1227 can be directly inserted and fixed to the floater 112 for preventing the conical insertion joint 1227 from falling out. The periphery of the conical insertion joint 1227 can be provided with a barbed structure 122, etc.

In particular, the third insertion portion can specifically adopt the insertion hole 1228 or the convex pillar 1229. When the third insertion portion is the convex pillar 1229, the support rod 121 should be a hollow structure, while the shape and size of the periphery of the convex pillar 1229 can match the shape and size of the perforation of the support rod 121, or the first end of the support rod 121 is provided with an insertion hole.

Figure 12:
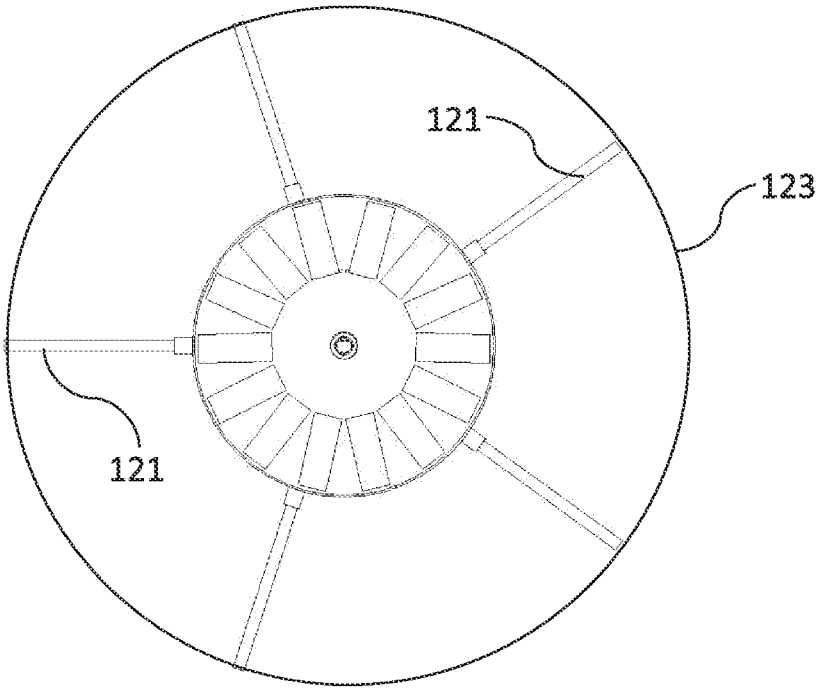
FIG. 12 is a schematic diagram of the solar landscape apparatus according to a further embodiment of the present disclosure.

As shown in FIG. 12, besides the support rod 121, the support member 12 can further include the annular blocking ring 23. The second ends of the plurality of support rods 121 are detachably connected with the annular blocking ring 23, respectively. Through the annular blocking ring 23, the proper distance between the solar landscape device and the ornaments can be maintained even when the solar landscape device is placed in the water provided with ornaments, such as the rockery. Meanwhile, the annular blocking ring 23 can also improve the floating stability of the whole solar landscape device in the water.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

The invention claimed is:

1. A solar landscape apparatus comprising a floating body, a support member, a solar panel, a solar battery and an electrical device; wherein the floating body is composed of a material with a density lower than that of water; wherein the solar panel, the solar battery and the electrical device are respectively located on the floating body and the solar battery is electrically connected with the solar panel and the solar battery respectively; wherein the support member is installed on the floating body and at least a part of the support member protrudes from a periphery of the floating body to prevent the floating body from leaning against a water edge; wherein the support member comprises a plurality of support rods, wherein a first end of each support rod is fixed on the floating body through a detachable assembly member, and a second end of each support rod protrudes from the periphery of the floating body.

2. The solar landscape apparatus according to claim 1, wherein the support rod has a density which is higher than or equal to that of the water, and when the solar landscape apparatus is floating on a water surface, the support rod is located below the water surface.

3. The solar landscape apparatus according to claim 1, wherein the plurality of support rods are radially distributed around the floating body, and a length of the second end of the support rod protruding from the periphery of the floating body is not less than a half of a width of the floating body.

4. The solar landscape apparatus according to claim 1, wherein the detachable assembly member comprises a horizontal connection portion and a first insertion portion integrated with the horizontal connection portion and arranged at a backside of the horizontal connection portion; wherein the detachable assembly member is fixed to an edge of the floating body through the horizontal connection portion and the first end of the support rod is inserted into the first insertion portion.

5. The solar landscape apparatus according to claim 4, wherein the first insertion portion is formed by an insertion hole and the first end of the support rod is inserted into the insertion hole.

6. The solar landscape apparatus according to claim 4, wherein the first insertion portion is formed by a convex pillar and the first end of the support rod is provided with a perforation for inserting the convex pillar.

7. The solar landscape apparatus according to claim 1, wherein the detachable assembly member comprises a clamping groove portion and a second insertion portion integrated with the clamping groove portion and located on one side of the clamping groove portion; wherein the detachable assembly member is fixed to an edge of the floating body through the clamping groove portion and the first end of the support rod is inserted into the second insertion portion.

8. The solar landscape apparatus according to claim 7, wherein the clamping groove portion includes a vertical clamping groove and an edge of a support plate of the floating body is provided with a vertical fastener, wherein a detachable assembly member is fixed to the support plate by inserting the vertical fastener into the clamping groove of the clamping groove portion.

9. The solar landscape apparatus according to claim 1, wherein the detachable assembly member comprises a conical insertion joint and a third insertion portion integrated with the conical insertion joint and arranged at a backside of the conical insertion joint; wherein the detachable assembly member is fixed to an edge of the floating body through the conical insertion joint and the first end of the support rod is inserted into the third insertion portion.

10. The solar landscape apparatus according to claim 9, wherein the floating body comprises a floating plate and a floater, and the conical insertion joint is directly inserted and fixed to the floater.

11. The solar landscape apparatus according to claim 10, wherein a periphery of the conical insertion joint is provided with a barbed structure.

12. The solar landscape apparatus according to claim 1, wherein the support member comprises an annular blocking ring and the second ends of the plurality of the support rods are detachably connected with the annular blocking ring, respectively.

13. The solar landscape apparatus according to claim 1, wherein the electrical device comprises a first circuit board and a water pump; wherein the floating body is provided with a through-hole and the solar panel is located on an upper surface of the floating body; wherein the first circuit board, the water pump and the solar battery are respectively installed on a lower surface of the floating body; wherein the water pump and the solar battery are respectively electrically connected with the first circuit board.

14. The solar landscape apparatus according to claim 1, wherein the electrical device comprises a second circuit board and a LED lamp bead located on an upper surface of the second circuit board; wherein the solar panel is fixed on an upper surface of the floating body, the solar battery is installed on a lower surface of the floating body, wherein the second circuit board is fixed on the upper surface of the floating body and is electrically connected with the solar battery.

* * * * *